United States Patent [19]

Matt et al.

[11] 4,455,840

[45] Jun. 26, 1984

[54] RING COMBUSTION CHAMBER WITH RING BURNER FOR GAS TURBINES

[75] Inventors: Bernhard Matt, Rheinheim, Fed. Rep. of Germany; Theo Woringer, Zurich; Gerassime Zouzoulas, Dietikon, both of Switzerland

[73] Assignee: BBC Brown, Boveri & Company, Limited, Baden, Switzerland

[21] Appl. No.: 349,853

[22] Filed: Feb. 18, 1982

[30] Foreign Application Priority Data

Mar. 4, 1981 [CH] Switzerland ..... 1439/81

[51] Int. Cl.[3] ..... F02G 3/00; F02G 1/00

[52] U.S. Cl. ..... 60/737; 60/743; 60/747

[58] Field of Search ..... 60/737, 738, 740, 746, 60/747, 749, 39.11, 39.465; 431/195, 278

[56] References Cited

U.S. PATENT DOCUMENTS

| | | | |
|---|---|---|---|
| 2,701,444 | 2/1955 | Day | 60/739 |
| 2,712,221 | 7/1955 | Pouchot | 60/261 |
| 3,046,731 | 7/1962 | Cambel et al. | 60/749 |
| 4,158,949 | 6/1979 | Reider | 60/737 |

*Primary Examiner*—Louis J. Casaregola
*Assistant Examiner*—Timothy S. Thorpe
*Attorney, Agent, or Firm*—Oblon, Fisher, Spivak, McClelland & Maier

[57] ABSTRACT

A ring burner of a ring combustion chamber is divided into a large number of honeycomb-like parallel axis canals for the combustion air, by radial and circumferential plate canals or by radial plate canals, longitudinal tubing, radial tubing and annular tubing into which combustion gas is introduced from nozzles in the surrounding walls. At the burner outlet there are flame retention nozzles provided above the frontal surface area of the plate canals or tubes. Fuel nozzles are provided in front of the burner inlet for operation as a dual burner with gaseous and liquid fuels.

5 Claims, 9 Drawing Figures

RING COMBUSTION CHAMBER WITH RING BURNER FOR GAS TURBINES

BACKGROUND OF THE INVENTION

1. Field of the Invention

The present invention relates to a ring combustion chamber with ring burner for gas turbines.

2. Description of the Prior Art

Compared to individual combustion chambers, ring combustion chambers have, among other things, the advantage of a more compact gas turbine construction. However, the pressure loss caused by a conventionally constructed ring combustion chamber is more often greater than that of an individual combustion chamber. Moreover, both share the common characteristic of unsatisfactory pre-turbine temperature distribution.

Today's common burners for ring combustion chambers consist of a relatively small number of individual burners distributed around the circumference of the ring combustion chamber, generally 10 to 20 burners but up to 48 in exceptional instances. Thus, the temperature distribution in the gas stream when entering the turbine is not as uniform as is desired, particularly with a small number of individual burners. Moreover, with these burners a large recirculation zone is needed for satisfactory flame stabilization. Such a zone is produced with twist generators (twisters) or flame retention baffles which exacerbate the pressure loss in the combustion chamber.

A further disadvantage for such conventional burners is that, at least in the ignition zone of the fuel/air mixture, stoichiometric conditions exist and thus locally high flame temperatures which encourage the formation of nitrogen monoxides. Thus, the total air flow through the burner is, with the exception of the cooling air stream, divided into a primary air stream flowing through the combustion zone and one or more air mix streams which must be well mixed and swirled with the combustion gases after leaving the burner exhaust. This calls for high speeds with correspondingly large pressure losses.

SUMMARY OF THE INVENTION

The present ring combustion chamber with ring burner will alleviate the above-mentioned disadvantages associated with individual burners. The object of the invention is the provision of a very good, thorough mixture of air with the gaseous and/or liquid fuel even before the ignition zone. The results are lower temperature peaks, more uniform temperature distribution upstream of the gas turbine, and a reduction in nitrogen monoxide formation. Proper selection of air speed avoids backfiring. Furthermore, the customary high resistance increasing elements that produce turbulence or a return flow are eliminated thereby eliminating the pressure losses associated with them.

The ring combustion chamber according to the invention is also intended in principle for use with gaseous as well as liquid fuels or simultaneous operation with gaseous and liquid fuels.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
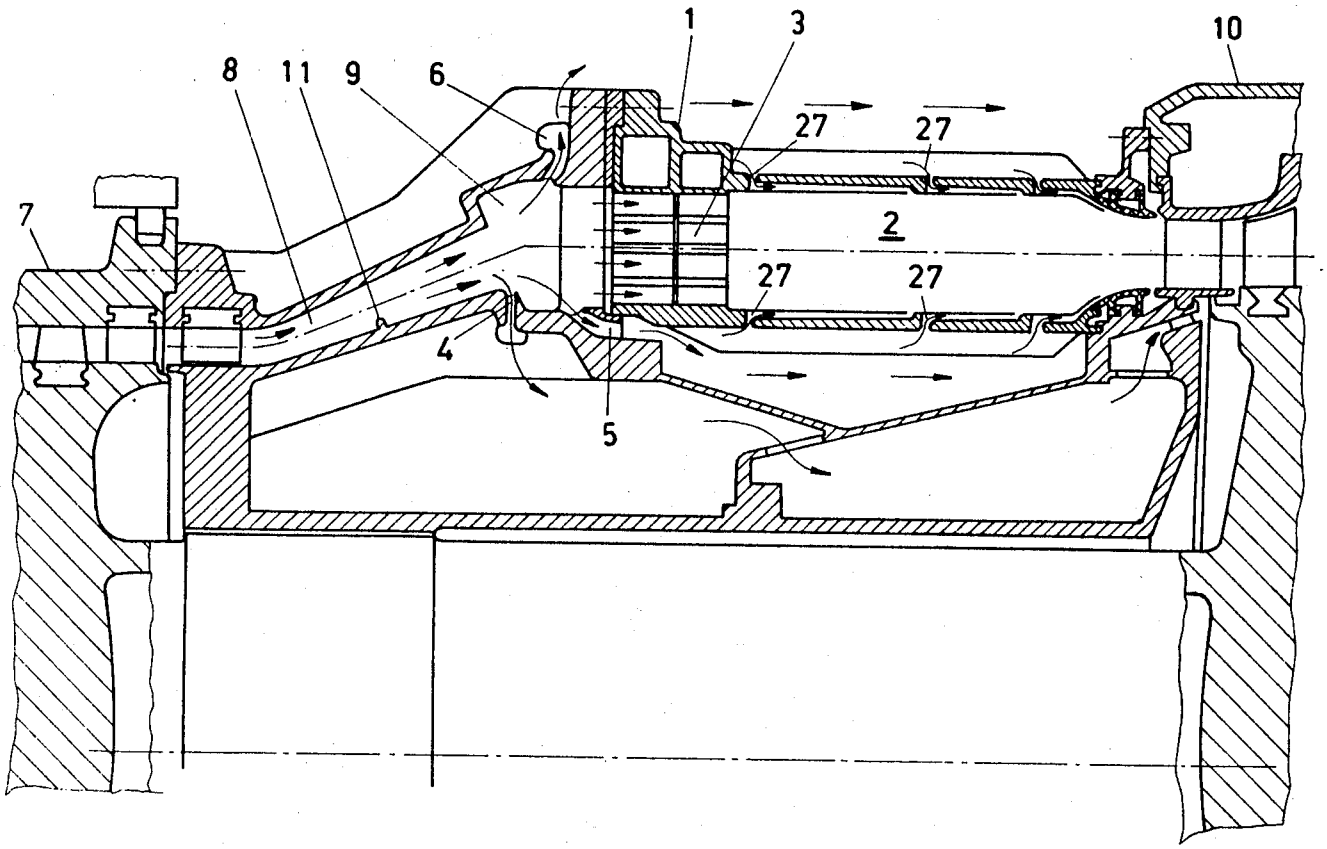
FIG. 1 is a schematic cross section of a gas turbine with a ring combustion chamber/ring burner combination according to the invention.

FIG. 1 shows a ring combustion chamber with ring burner according to the invention within an otherwise conventional gas turbine. The combination of combustion chamber 2 and burner 3 is labeled 1 and has a common housing. The combustion chamber 2 and the burner 3 should be separate components to be practical, particularly in larger units where, as is discussed hereinbelow, the ring burner 3 is preferably formed out of sections. Combustion air flows from the compressor 7 through a ring diffuser 8, which widens before reaching the ring burner 3 to form an impact diffusor 9, and into the burner 3 where it is thoroughly and uniformly mixed with gaseous fuel or with gaseous fuel plus an atomized liquid fuel, over the entire canal cross section. As indicated by arrows in FIG. 1, a small amount of the combustion air is used for cooling the shaft and the housing. The cooling air is diverted at the draw-off points 4, 5 and 6. At the burner exhaust point the fuel mixture ignites, and the combustion gases travel through the combustion chamber 2 where some of the cooling air that was diverted before the burner is added to the combustion gases in order to perform work in the turbine 10. In the ring diffusor 8 there is a ring-shaped trip bead 11 which creates turbulence and assures nearly uniform speed distribution through the height of the diffusor canal.

Due to the advantageous characteristics of the ring burner, the combustion chamber 2 can be constructed essentially as a smooth canal according to FIG. 1 without the otherwise common inserts to swirl the fuel mixture. The following description is therefore limited to the ring burner alone which, as discussed above, is generally constructed as a separate component from the ring combustion chamber.

The ring burner 3 is preferably made up of ring sections, particularly with larger units. The number of such sections will generally depend on the size of the burner. A section 12 shown in projection in FIGS. 2 and 3 and in a radial section extends 22.5°, i.e., the associated total burner consists of 16 such sections. The radially outermost part of the section forms the gas distributor box 13, which, as FIG. 3 shows, is divided by the separating bulkhead 14 into a primary gas chamber 15 and an ignition gas chamber 16 to which gaseous fuel is supplied through the gas supply lines 17 and 18. These two gas supply lines in turn branch off from a master line that is not shown. Radially oriented plate canals 19 and 20 respectively branch off from the two gas chambers 15 and 16 of the gas distributor box 13. These intersect vertically with the plate canals 21 and 22 which run in the direction of the circumference of the section.

The plate canals 19 to 22 form a grid-like canal network that communicates with the gas distributor box 13. The grid network defines honeycomb cells of approximately trapezoidal cross section into which, during operation, gas flows through nozzles 23, 24 in the canal walls. FIG. 3 shows that a first row of nozzles lying in a first radial plane is provided in each honeycomb for the primary gas and that a second row of nozzles lying in a second radial plane is provided for the ignition gas. Of course, depending on the burner output, two or more such nozzle rows could be provided which could either be flush in the flow direction or staggered one behind the other. In the illustrated embodiment all four sides of the two central honeycomb rows consist of the plate canals 19 or 20 respectively, while in the case of the radially outermost and innermost honeycomb rows, the radially outer and radially inner sides are formed by protective sheets 25 and 26, respectively. In the radially outer and radially inner honeycomb rows, gas travels only from the two radial plate canals and one circumferential plate canal.

Figure 2:
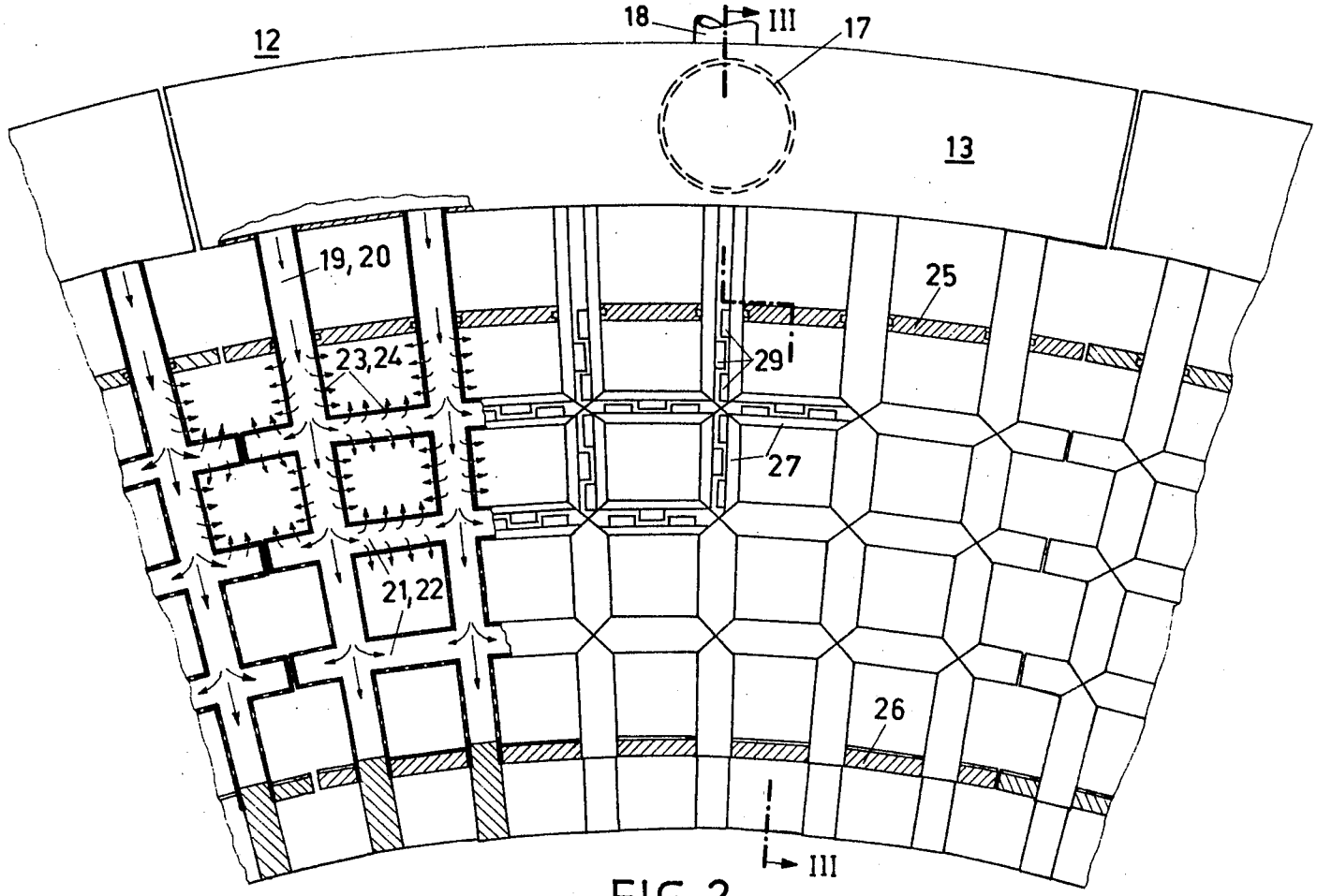
FIG. 2 is a front view of a section of a ring burner as a component of the present invention.
Figure 3:
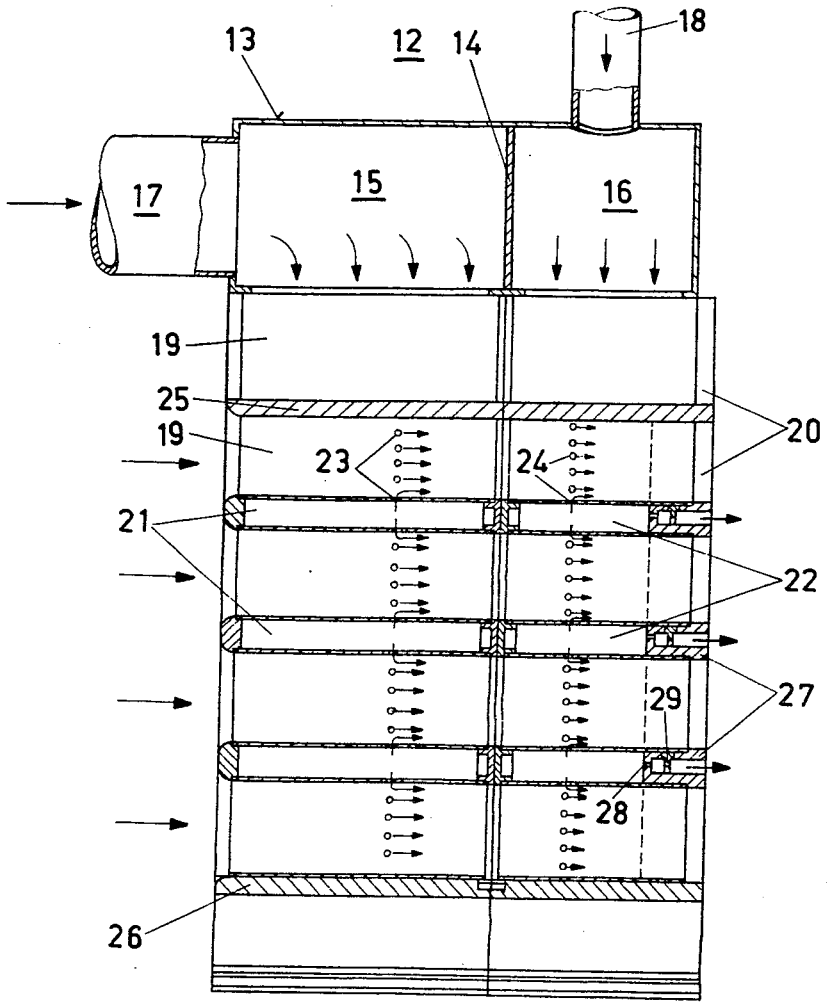
FIG. 3 is a radial section along lines III—III in FIG. 2.

At the burner outlet (i.e., at the front end of all the plate canals, looking towards the burner 3 in the direction opposite to the gas flow); flame retention baffles 27 are provided for the ignition gas, which in the case of the two central honeycomb rows exhibit the double trapezoid shape seen in FIG. 2. To facilitate a clear view, the complete front view of these flame retention baffles are drawn in only for the central radially outer honeycomb forms.

FIG. 3 shows the U-shaped cross section of the flame retention baffle 27 having nozzles 28 located in the bridge of the U and impact plates 29 located in the slotted escape canal in front of the flame retention baffle nozzles 28. FIG. 2 shows how the impact plates 29 are positioned adjacent each other in order to generate a good swirl in the escaping gas stream for the pilot flame.

To fire the burner the pilot flame is lit, which then ignites the gas simultaneously leaving the ignition gas nozzles 24 at the burner output. Since both the ignition gas jets 24 and the flame retention nozzles 28 are fed by the ignition gas chamber, the gas stream for the pilot flame is approximately proportional to the gas stream leaving the ignition gas nozzles 24, with which the turbine can be driven with no load or perhaps with a slight load. For greater output, primary gas is fed in from the primary gas nozzles 23. The gas is mixed well with air even before leaving the burner and without swirling due to the many gas nozzles 23 and 24 evenly distributed along the inside circumference of the honeycomb canals in combination with the long mixing path leading to the burner outlet. Thus, combustion is uniform over the entire burner cross section with very little pressure loss and a large air surplus. The temperature of the turbine is also correspondingly equalized by the combustion gases, to which cooling air removed at the draw-off points 4, 5 and 6 is added through slots 30 in the combustion chamber wall only in the marginal zone.

Figure 4:
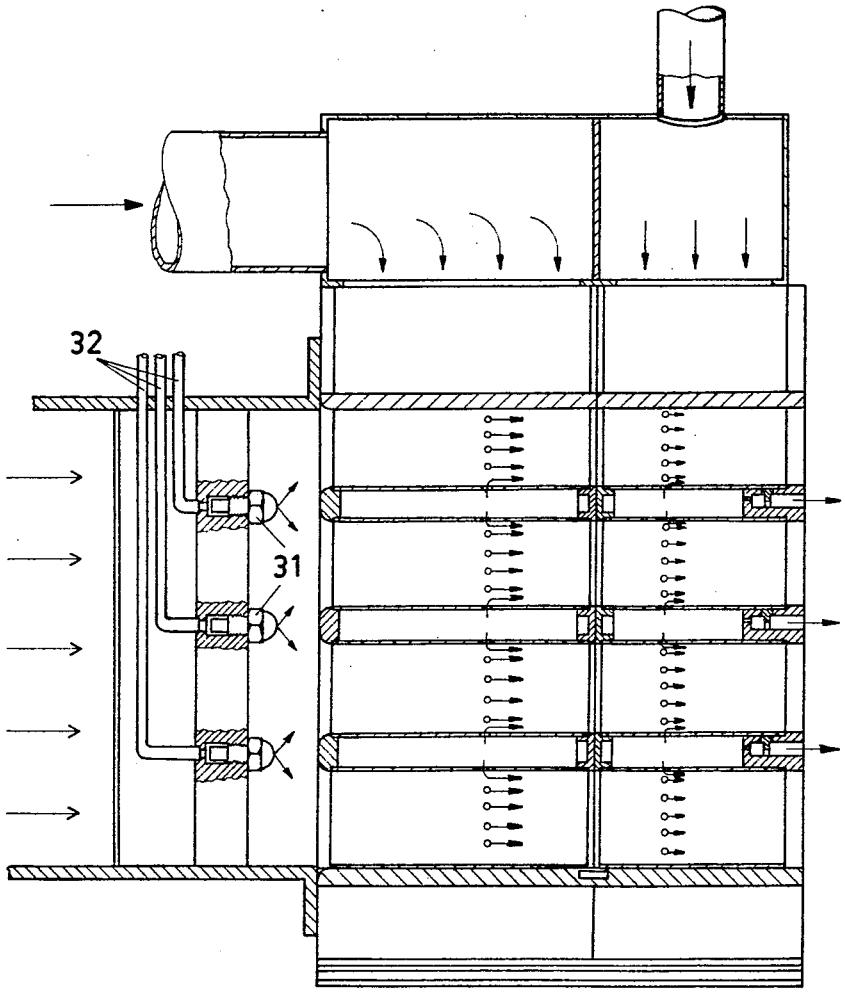
FIG. 4 is a radial section through a dual ring burner according to the invention that operates on gas and liquid fuel.

FIG. 4 shows a radial section through a section of a dual burner capable of being run on liquid and gaseous fuel. In addition to the elements used for gas burner operation, the dual burner has liquid fuel nozzles 31 situated in radially extending rows in front of the burner inlet. The liquid fuel nozzles 31 deliver the atomized liquid fuel needed to operate the turbine under load after the burner has been shifted up from load-free operation (i.e., idling) with ignition gas. The liquid fuel nozzles 31 switch in by way of fuel lines 32 in rows or in groups, depending on the load conditions. The ignition gas can then be shut off, since flame stabilization is then controlled by the return flow zone arising from the swirling at the burner outlet.

The axes of the liquid fuel nozzles 31 are aligned with the circumferential positions of the radial plate canals. Thus, the atomized liquid fuel stream is always directed into four honeycomb canals at the plate intersection points.

Figure 5:
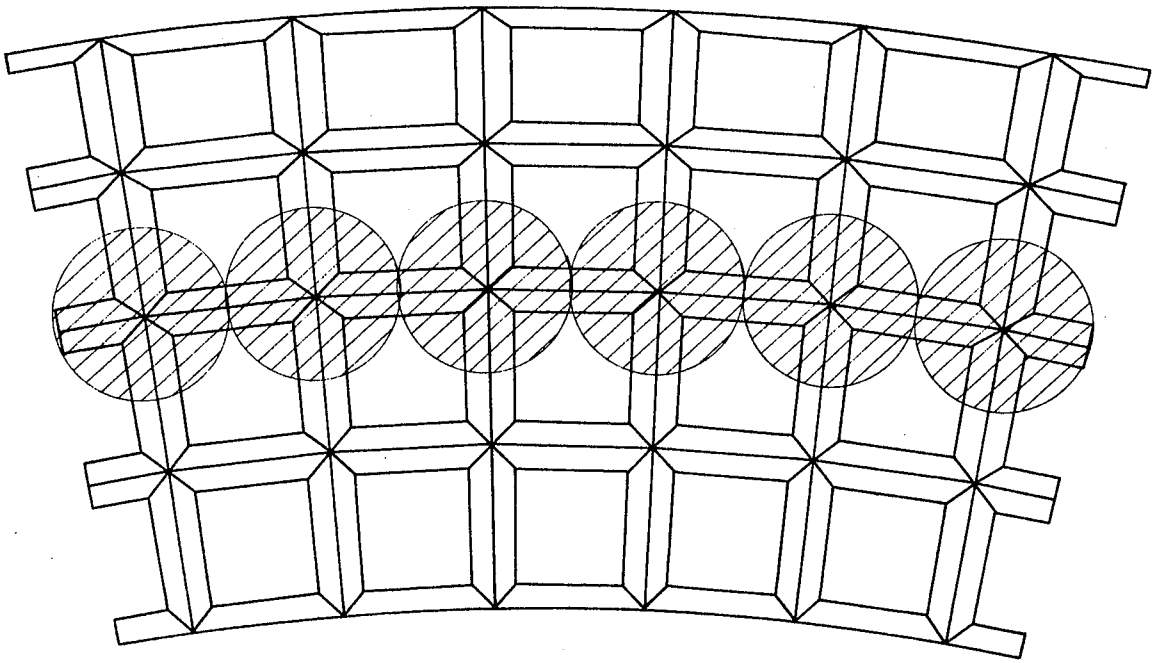
FIGS. 5 through 7 are schematic representations of the effective combustion zones of the dual ring burner of FIG. 4 under various load conditions.
Figure 6:
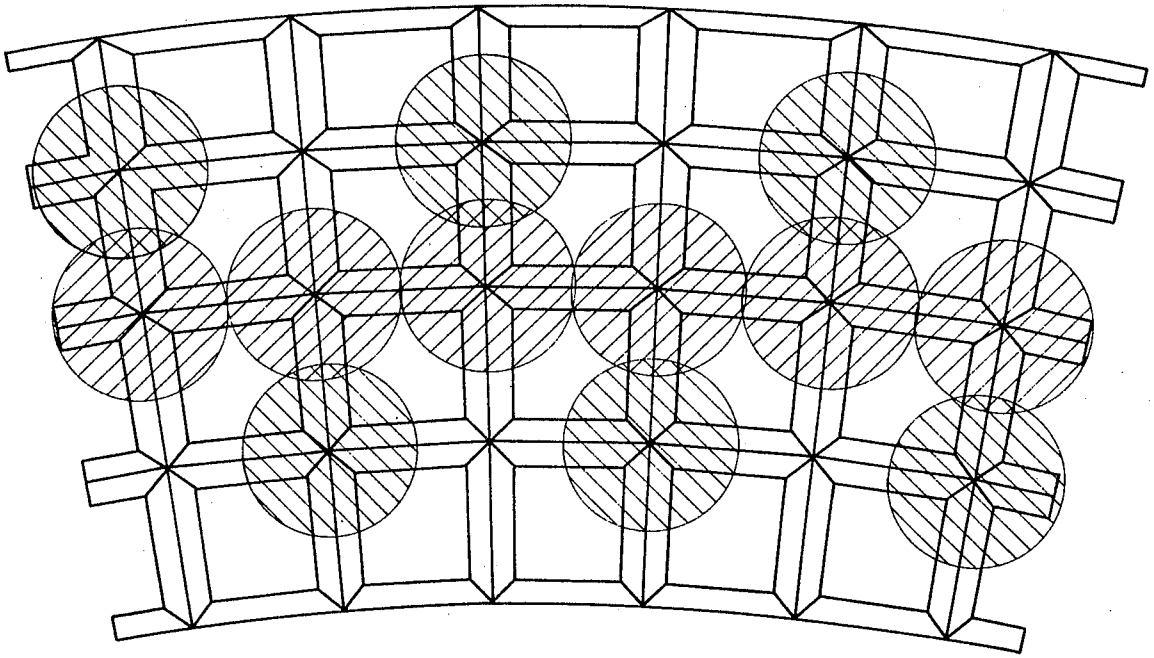
Figure 7:
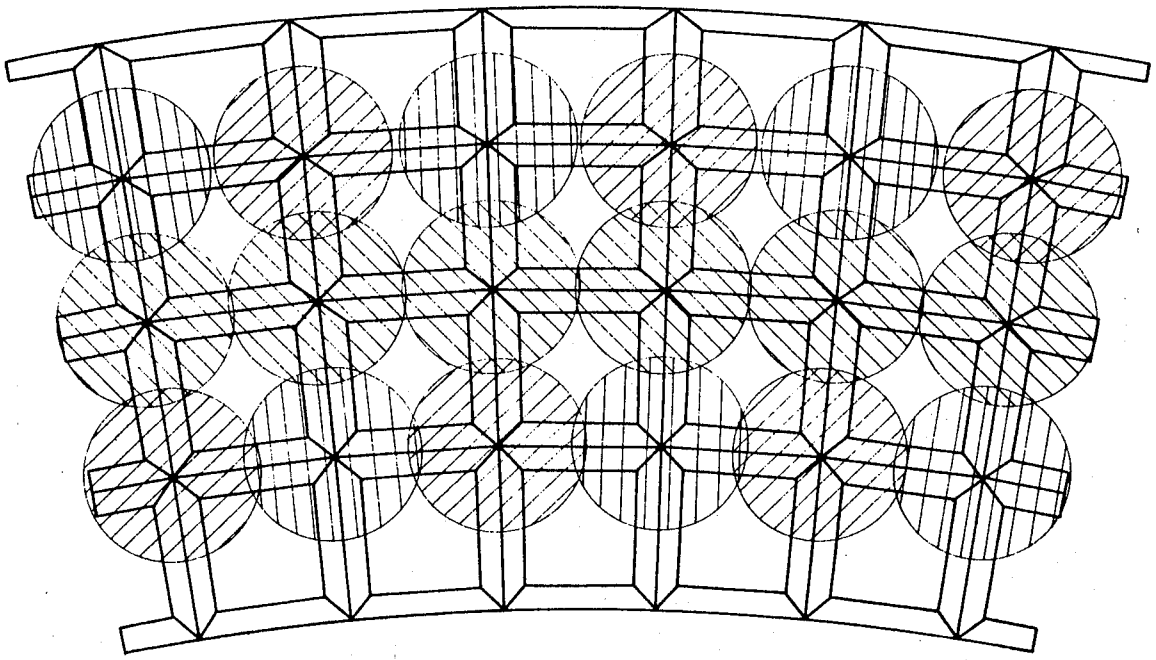

FIGS. 5 to 7 show schematically how this distribution of the fuel streams occurs and the liquid fuel nozzles activated under various load conditions: the shaded areas of FIG. 5 correspond to liquid fuel nozzles activated during idle operation, FIG. 6 shows the liquid fuel nozzles activated during partial loading, and FIG. 7 shows the liquid fuel nozzles activated during full loading. For partial loading, various combinations of active liquid fuel nozzles are possible, depending on the particular situation, as is known.

Figure 8:
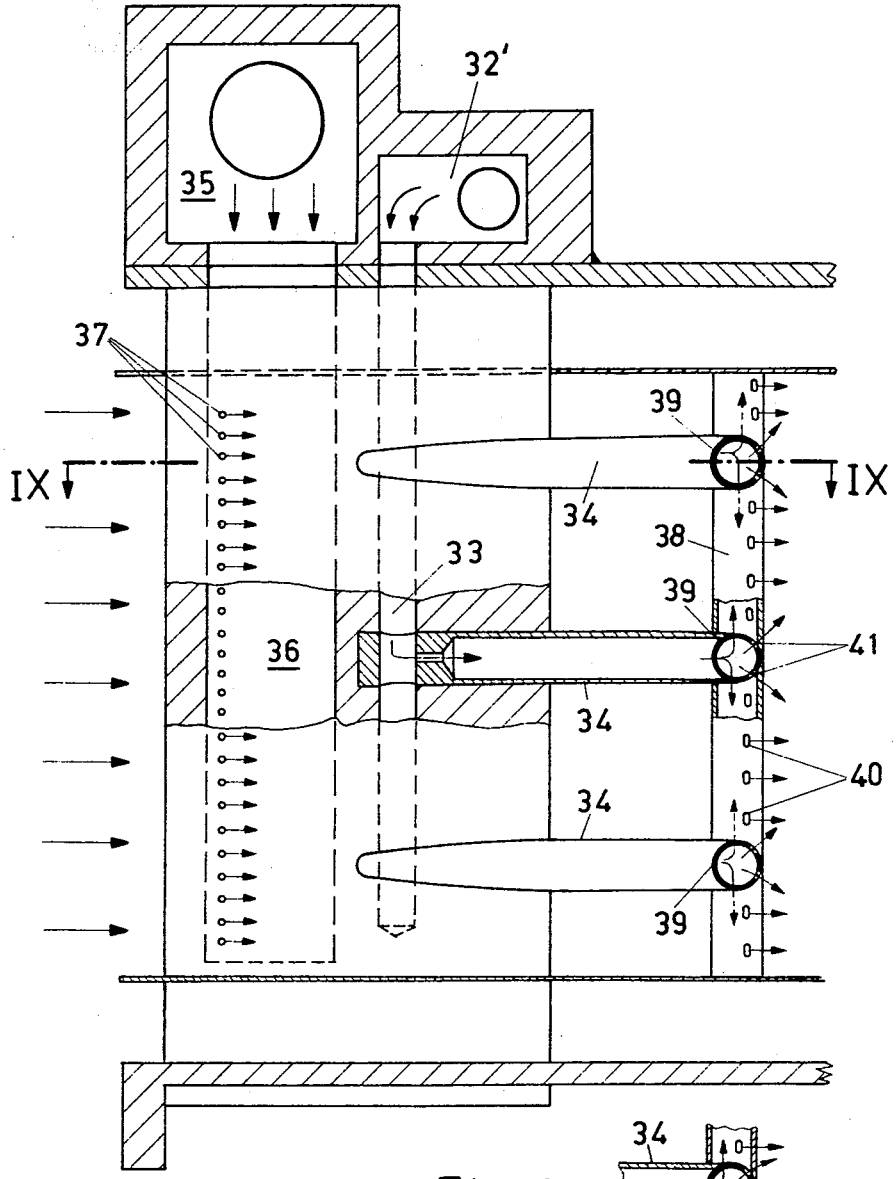
FIG. 8 is a radial section through a sector of another embodiment of a ring burner intended for gas operation.
Figure 9:
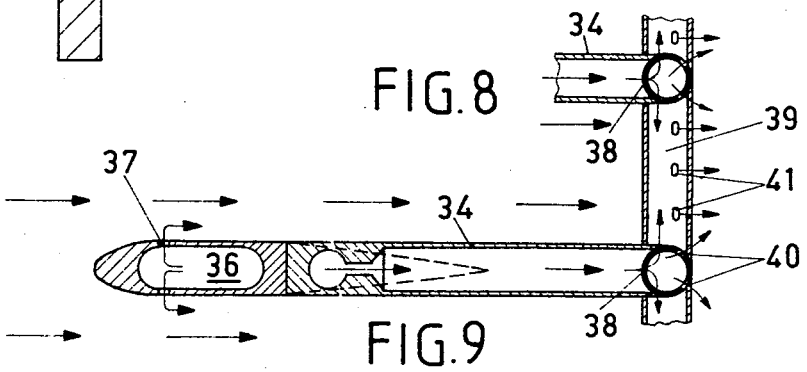
FIG. 9 is a cross section along the section lines IX—IX shown in FIG. 8.

With the variant of a burner for gas operation only shown in FIGS. 8 and 9, the ignition gas fed through the ignition gas chamber 32', ignition gas canals 33, and longitudinal tubing 34 branching off from the latter to a tubing network at the burner output serves only to stabilize the flame. The turbine is driven only by primary gas across the entire load range. The primary gas travels from the primary gas chamber 35 into radial plate canals 36 and from these through primary gas nozzles 37 into the air canals defined by adjacent plate canals 36. The longitudinal tubing 34 running parallel to the turbine axis opens into the tubing network at the joints formed by intersecting radial tubing 38 and annular tubing 39. The radial tubing 38 and the annular tubing 39 are each provided with two rows of flame retention nozzles 40 and 41 respectively, whose axes are tipped at a sharp angle to the flow direction of the burner.

The tubing network in this embodiment does not form closed, defined canals as in the embodiments in FIG. 2 to 4. However, due to the compact distribution of the primary gas nozzles 37 along the height of the canal and across the burner cross section, good uniform gas and air mixture with the advantages described at the outset is also assured.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A ring combustion chamber for a gas turbine, said ring combustion chamber comprising:

(a) an array of a plurality of radially extending canals uniformly distributed about a central axis, each of said radially extending canals being formed from two pairs of generally parallel planar plates;

(b) an array of a plurality of circumferentally extending canals radially distributed about said central axis, each of said circumferentially extending canals:

(i) being formed from two pairs of generally parallel planar plates;

(ii) having an upstream end which is open to combustion air and a downstream end which communicates with a turbine; and (iii) intersecting with each of the radially extending canals in said array of radially extending canals, whereby the intersections of the canals in the two arrays of canals form a grid-like canal system composed of honeycomb cells of generally trapezodial cross section;

(c) a first array of nozzles for the introduction of ignition gas into each canal in said array of circumferentially extending canals, said first array of nozzles being located in a first plane perpendicular to said central axis; and (d) a second array of nozzles for the introduction of primary gaseous fuel into each canal in said array of circumferentially extending canals, said second array of nozzles being located in a second plane perpendicular to said central axis, said second plane being downstream of said first plane, whereby said grid-like canal system and said nozzles define an array of burner elements uniformly distributed around said central axis, said burner elements being stacked one upon another in both the radial and circumferential directions.

2. A ring combustion chamber for a gas turbine as recited in claim 1 and further comprising flame retention baffles located in the downstream ends of each of the canals in said array of circumferentially extending canals.

3. A ring combustion chamber for a gas turbine as recited in claim 2 wherein:

(a) said flame retention baffles are U-shaped in cross section;

(b) have outlet nozzles located at the bridge of the U; and (c) have impact plates located in a slotted escape canal upstream of said outlet nozzles.

4. A ring combustion chamber for a gas turbine as recited in claim 1 and further comprising a plurality of liquid fuel nozzles located upstream of the upstream ends of the canals in said array of circumferentially extending canals, said liquid fuel nozzles being aligned coaxially with lines defined by the intersection of the two arrays of canals.

5. A ring combustion chamber for a gas turbine as recited in claim 1 wherein said ring combustion chamber is divided into sections circumferentially.

* * * * *